United States Patent [19]

Bennetot

[11] Patent Number: 4,485,574

[45] Date of Patent: Dec. 4, 1984

[54] THREE-SECTION HOOP EMBROIDERY FRAME

[75] Inventor: Remy J. P. Bennetot, Pont Sainte-Marie, France

[73] Assignee: Societe Industrielle de Decoration et Application S.I.D.A., Troyes, France

[21] Appl. No.: 461,502

[22] Filed: Jan. 27, 1983

[30] Foreign Application Priority Data

Feb. 5, 1982 [FR] France ..... 82 02268

[51] Int. Cl.[3] ..... D05C 9/04; D06C 3/08

[52] U.S. Cl. ..... 38/102.2; 112/103; 160/179; 160/380

[58] Field of Search ..... 38/102.2; 112/103, 121.15; 160/380, 179, 353

[56] References Cited

U.S. PATENT DOCUMENTS

| | | | |
|---|---|---|---|
| Re. 30,476 | 1/1981 | Jennen et al. | 38/102.2 |
| 2,817,399 | 12/1957 | Donaldson et al. | 160/380 X |
| 2,957,269 | 10/1960 | Nohl et al. | 38/102.2 |
| 3,729,045 | 4/1973 | MacDonald | 160/380 |
| 3,885,333 | 5/1975 | Zachary | 38/102.2 |
| 4,010,562 | 3/1977 | Maier | 38/102.2 |
| 4,193,235 | 3/1980 | Cucchiara | 160/380 X |

FOREIGN PATENT DOCUMENTS

| | | | |
|---|---|---|---|
| 85638 | 2/1983 | European Pat. Off. | 38/102.2 |
| 761636 | 9/1980 | U.S.S.R. | 38/102.2 |

*Primary Examiner*—Werner H. Schroeder
*Assistant Examiner*—Andrew M. Falik
*Attorney, Agent, or Firm*—Karl F. Ross; Herbert Dubno

[57] ABSTRACT

A hoop for holding a piece of textile and a backing web for embroidery on the textile piece comprises outer, intermediate and inner rings. The outer ring is generally rigid, formed of a limitedly elastically deformable synthetic resin, and has a generally polygonal inner periphery generally centered on an axis. The intermediate ring is formed of a limitedly elastically deformable synthetic resin and has an outer periphery generally complementary to and axially fittable with limited play within the inner periphery of the outer ring and a generally polygonal inner periphery. Thus the intermediate ring can be elastically deformed and snapped into the outer ring with the backing web gripped between the inner periphery of the outer ring and the outer periphery of the intermediate ring. The inner ring is formed of a limitedly elastically deformable synthetic resin and has an outer periphery generally complementary to and axially fittable with the limited play within the inner periphery of the intermediate ring.

12 Claims, 7 Drawing Figures

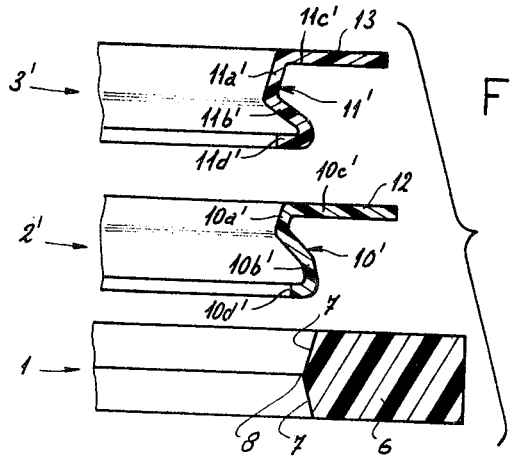
FIG. 5
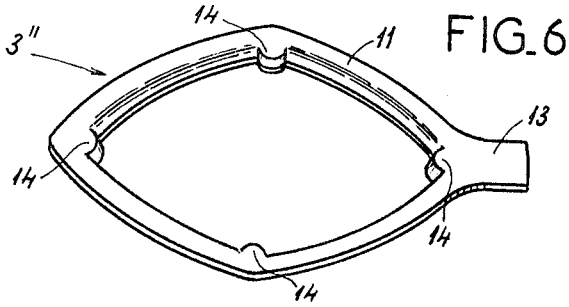
FIG. 6
FIG. 7
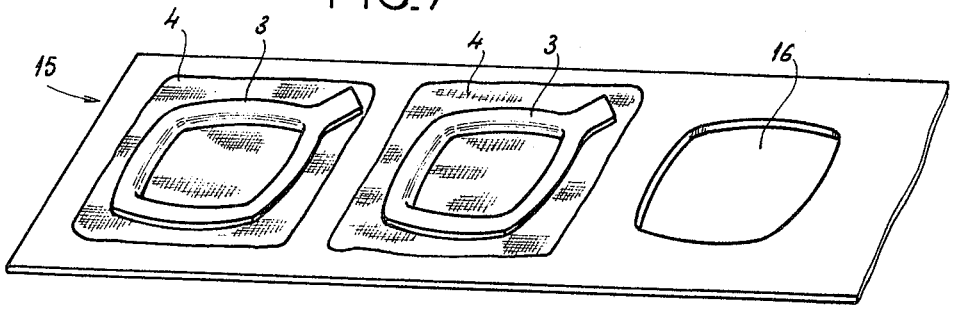

THREE-SECTION HOOP EMBROIDERY FRAME

FIELD OF THE INVENTION

The present invention relates to an embroidery hoop. More particularly this invention concerns such a hoop which is used to hold a piece of textile and a backing web or sheet for embroidery on the textile by an embroidery machine.

BACKGROUND OF THE INVENTION

Nowadays automatic cam- or computer-controlled embroidery machines mass produce virtually all embroidered goods. Such machines typically have several heads that work synchronously to similtaneously form the same stitches in respective pieces of goods. These goods are held in respective embroidery hoops constituted as holders that fit a guide on or are otherwise attched to the machine plate underneath the respective sewing heads.

For most types of textile goods it is necessary to provide a normally unwoven backing web on the back side of the goods. This backing web holds up the support textile which often is a light fabric or a mesh. It can be a cheap felt or even paper.

The hoop normally comprises a fixed-diameter inner ring and a variable-diameter outer ring which is provided with a screw tightener or spring. The textile piece to be embroidered with the backing web underlying it are laid on top of the inner ring and the outer ring is fitted over it and tightened to hold the piece and web snugly. The hoop is then fitted to the machine which may be provided with a seat into which the hoop can fit snugly underneath the respective head.

The problem with such arrangements is that the web and/or the textile piece to be embroidered are pinched and cut between the inner and outer rings. There is inevitably some bunching and pinching of the piece and web which lead to such tight compression at the bunched locations that the fibers are severed. This is particularly the problem when the piece being embroidered is relatively thick.

Another problem with these known arrangements is that it is difficult to get both the web and textile piece smooth. They are compressed together so tugging on one projecting edge to tighen the respective web or piece will normally entrain the other and make it too tight.

OBJECTS OF THE INVENTION

It is therefore an object of the present invention to provide an improved goods-holding hoop for an automatic embroidery machine.

Another object is the provision of such a goods-holding hoop for an automatic embroidery machine which overcomes the above-given disadvantages.

Yet another object is to provide an embroidery hoop which holds the piece being embroidered and the backing web securely, but without pinching and cutting either whole allowing each to be adjusted in the hoop independently of the other.

SUMMARY OF THE INVENTION

These objects are attained according to the instant invention in a hoop for holding a piece of textile and a backing web for embroidery on the textile piece comprising outer, intermediate and inner rings. The outer ring is generally rigid, formed of a limitedly elastically deformable synthetic resin, and has a generally polygonal inner periphery generally centered on an axis. The intermediate ring is formed of a limitedly elastically deformable synthetic resin and has an outer periphery generally complementary to and axially fittable with limited play within the inner periphery of the outer ring and a generally polygonal inner periphery. Thus the intermediate ring can be elastically deformed and snapped into the outer ring with the backing web gripped between the inner periphery of the outer ring and the outer periphery of the intermediate ring. The inner ring is formed of a limitedly elastically deformable synthetic resin and has an outer periphery generally complementary to and axially fittable with limited play within the inner periphery of the intermediate ring. Thus the inner ring can be elastically deformed and snapped into the intermediate ring with the textile piece gripped between the outer periphery of the inner ring and the inner periphery of the intermediate ring.

With this system the backing web and the textile piece are held separately so they can be adjusted in the hoop separately. In addition the plastic rings will not excessively pinch and therefore cut the goods, which since they are not both held together will not bunch up as much anyhow.

According to another feature of this invention the outer ring is of solid and generally rectangular cross section and has a width dimension perpendicular to the axis which is substantially greater than its height dimension parallel to the axis. The inner periphery of the outer ring is formed of slightly inwardly concave sides each having a central inwardly directed ridge. Similarly the intermediate and inner rings are both generally of L-section, each having an inner flange forming the respective inner periphery and another substantially planar flange generally perpendicular thereto and extending outward perpendicular to the axis away from the respective inner flange. The inner flanges each form a shallow outwardly open groove and the inner flange of the intermediate ring is formed with an inwardly projecting annular ridge, the ridges of the outer and intermediate rings fitting into the grooves of the respective intermediate and inner rings. Thus both of the inner flanges are generally of radially outwardly open V-section.

The inner flanges of the system of this invention are formed with inwardly directed lips of substantially smaller dimension than the respective outer flanges and each perpendicular to the axis. These lips stiffen the inner and intermediate rings somewhat.

To provide the above-mentioned axial play between the inner and intermediate rings, the inner flange of the inner ring is axially slightly longer than the inner flange of the intermediate ring. In addition the outer periphery of the intermediate ring is outwardly concave and the inner periphery of the outer ring is generally complementarily inwardly concave but of smaller curvature.

To make it possible to pull the goods tight and to prevent bunching, the inner periphery of the outer ring has sides meeting at corners and is formed at these corners with inwardly open cutout notches defining respective gaps with the intermediate ring. Thus the web gripped between the outer and intermediate rings can bunch in these notches at the corners. Similarly according to the invention the outer periphery of the inner ring has sides meeting at corners and is formed at these corners with outwardly open notches defining respective gaps with the intermediate ring. Thus the textile piece gripped between the inner and intermediate rings can bunch in these notches at the corners. The generally straight sides of the rings, which are curved to give them maximum strength and outward springiness, allow the textile piece and backing web to be pulled tight relatively easily.

For use on an automatic embroidery machine having several stitching heads the outer ring has an outer periphery of predetermined shape. In addition a mounting plate is formed with a plurality of holding seats each having a shape complementary to the predetermined shape of the outer periphery of the outer ring. Thus one such outer ring fitted with a respective backing web, intermediate ring, textile piece, and inner ring can be held in each such recess. The plate itself is adapted to fit in preset guides in the embroidery machine.

In accordance with another feature of this invention the rings are all wholly annularly continuous. In addition the inner and intermediate rings are of generally uniform section. At least the the inner and intermediate rings are formed of a polycarbonate, a resin known for its good elastic, not plastic, deformability, resistance to abrasion, and light weight.

DESCRIPTION OF THE DRAWING

The above and other features and advantages will become more readily apparent from the following, reference being made to the accompanying drawing in which:

FIG. 5 is a sectional view like FIG. 2 of another hoop according to this invention;

FIG. 6 is a perspective view of a detail of the hoop of FIG. 5; and

FIG. 7 is a perspective view of a further element of the instant invention in combination with the hoop of FIG. 1.

SPECIFIC DESCRIPTION

Figure 1:
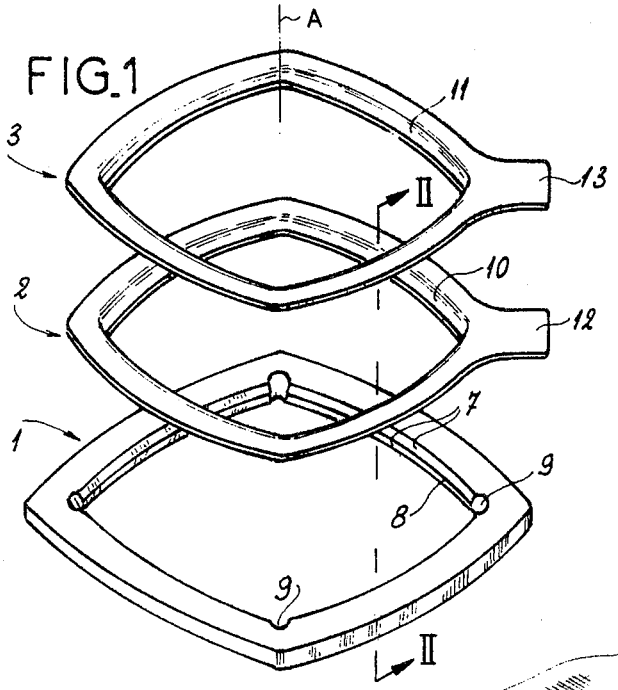
FIG. 1 is an exploded view of an embroidery hoop according to this invention.
Figure 3:
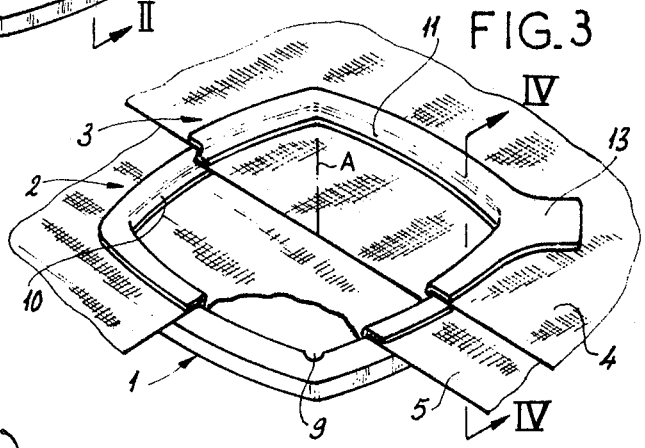
FIG. 3 is a perspective and partly broken-away view showing the FIG. 1 hoop in use.

As seen in FIGS. 1–4 the embroidery hoop according to this invention basically comprises an outer ring 1, an intermediate ring 2, and an inner ring 3, all made of polycarbonate and all generally centered on an axis A. They serve to hold a sheet or piece 4 of textile on which is to be embroidered, and a normally nontextile bcking sheet 5, the former between the rings 2 and 3 and the latter between the rings 1 and 2.

Figure 2:
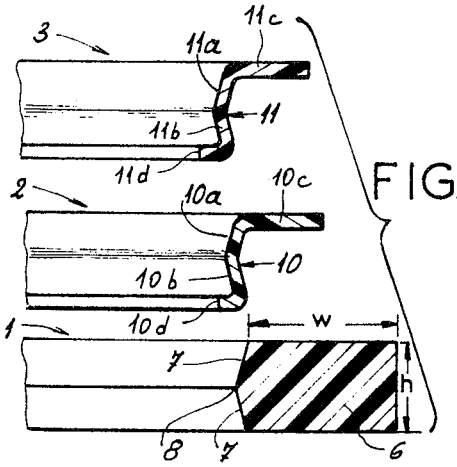
FIG. 2 is a section taken along line II—II of FIG. 1, but with the hoop assembled.

The outer ring 1 is of generally rectangular section and has a solid body 6 having four sides that are slightly arcuate, that is of a radius of curvature many times greater than the distance between these sides and the axis A, and are concave inwardly toward the axis. The axial height h of the ring 1 in section as shown in FIG. 2 is equal to about twice the radial width dimension w so that the ring 1 is quite stiff, especially resistant to deformation in the radial direction both due to the arcing of the four sides as well as the material thickness. The inner periphery of the ring 1 is formed by two identical but oppositely inclined flanks 7 meeting at a central inwardly directed ridge 8. In addition at each of its four corners the ring 1 is formed with an inwardly open part-frustoconical notch 9.

The intermediate ring 2 is of the same continuous annular shape with four inwardly concave arced sides as the ring 1, but is dimensioned slightly smaller than the ring 1 so it can fit snugly inside it. More particularly this ring 2 is generally of L-section as seen in FIG. 2, and has a body 10 having an inner flange **10*a*, 10*b* formed of two identical and oppositely inclined regions 10*a* and 10*b* forming an inwardly directed ridge and an outwardly directed groove, as the material of the body 10 is of uniform section. At the upper edge of the upper inner-flange portion 10*a* the body 10 is formed with an outer flange 10*c* that lies in a plane perpendicular to the axis A. Similarly at the lower edge of the lower inner-flange portion 10*b* the body 10 is formed with an inwardly projecting reinforcement lip 10*d* of substantially smaller radial dimension than the outer flange 10*c*. The axial distance between the outwardly open groove formed where the portions 10*a* and 10*b* meet and the underside of the flange 10*c* is generally equal to the axial distance between the ridge 8 and the top surface of the ring 1. In addition at one of its corners the ring 2 is formed with a tab 12 allowing it to be picked up and separated from the ring 1** easily.

Figure 4:
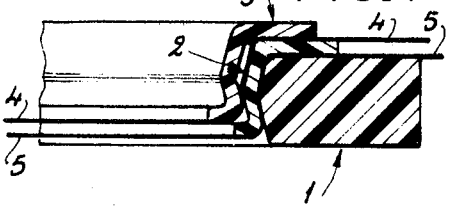
FIG. 4 is a section taken along line IV—IV of FIG. 3.

The inner ring 3 is almost identical to the ring 2, but is slightly smaller so it can fit snugly inside this ring 2. More particularly this ring 3 is generally of L-section as seen in FIG. 2, and has a body 11 having an inner flange **11*a*, 11*b* formed of two identical and oppositely inclined regions 11*a* and 11*b* forming an inwardly directed ridge and an outwardly directed groove, as the material of the body 11 is of uniform section. At the upper edge of the upper inner-flange portion 11*a* the body 11 is formed with an outer flange 11*c* that lies in a plane perpendicular to the axis A. Similarly at the lower edge of the lower inner-flange portion 11*b* the body 11 is formed with an inwardly projecting reinforcement lip 11*d* of substantially smaller radial dimension than the outer flange 11*c*. Although the rings 2 and 3 are substantially identical, the ring 3 merely being slightly smaller than the ring 2, the distance between the outwardly open groove formed between the portions 11*a* and 11*b* iand the underside of the flange 11*c*, when snapped together as shown in FIG. 4 the ring 3 will sit up on the ring 2, with its groove above the ridge of the ring 2 by a distance equal to the axial thickness of the flange 11*c* plus that of the textile piece 4. This creates some axial play between the rings 2 and 3. In addition at one of its corners the ring 3 is formed with a tab 13 allowing it to be picked up and separated from the ring 2** easily.

FIG. 5 shows another assembly wherein the ring 1 is identical to that of FIGS. 1–4, but the intermediate and inner rings 2' and 3' are different. The intermediate ring 2' is generally of L-section and has a body 10' having an inner flange **10*a*', 10*b*' formed of two dissimilar and oppositely inclined regions 10*a*' and 10*b*', the former being relatively short and forming a very acute angle with the axis A and the letter being axially somewhat longer and forming a substantially less acute angle with the axis A. These two portions 10*a*' and 10*b* form an inwardly directed ridge and an outwardly directed groove, as the material of the body 10' is of uniform section. At the upper edge of the upper inner-flange portion 10*a*' the body 10' is formed with an outer flange 10*c*' that lies in a plane perpendicular to the axis A. Similarly at the lower edge of the lower inner-flange portion 10*b*' the body 10' is formed with an inwardly projecting reinforcement lip 10***d*′ of substantially smaller radial dimension than the outer flange 10*c*′. The axial distance between the outwardly open groove formed where the portions 10*a*′ and 10*b*′ meet and the underside of the flange 10*c*′ is substantially shorter than the axial distance between the ridge 8 and the top surface of the ring 1.

The inner ring 3′ is also generally of L-section and has a body 11′ having an inner flange 11*a*′, 11*b*′ formed of two dissimilar and oppositely inclined regions 11*a*′ and 11*b*′, the former being relatively short and forming a very acute angle with the axis A and the letter being axially somewhat longer and forming a substantially less acute angle with the axis A. These two portions 11*a*′ and 11*b* form an inwardly directed ridge and an outwardly directed groove, as the material of the body 11′ is of uniform section. The portion 11*a*′ is sustantially longer than the corresponding portion 10*a*′ and the portion 11*b*′ is substantially shorter than the corresponding portion 10*b*′ of the ring 2′ so that the two rings 2′ and 3′ can fit snugly together. At the upper edge of the upper inner-flange portion 11*a*′ the body 11′ is formed with an outer flange 11*c*′ that lies in a plane perpendicular to the axis A. Similarly at the lower edge of the lower inner-flange portion 11*b*′ the body 11′ is formed with an inwardly projecting reinforcement lip 11*d*′ of substantially smaller radial dimension than the outer flange 11*c*′. The axial distance between the outwardly open groove formed where the portions 11*a*′ and 11*b*′ meet and the underside of the flange 11*c*′ is generally equal to the axial distance between the ridge 8 and the top surface of the ring 1.

FIG. 6 shows another inner ring 3″ identical to the ring 3 or 3′, but formed at each corner with an inwardly projecting bump forming an axially downwardly open notch 14 similar in function to the notches 9.

Finally FIG. 7 shows a plate 15 formed with several through holes or seats 16 each having a shape complementary to that of a ring 1 so that an assembled hoop 1, 2, 3 can be seated in it. The number of holes 16 as well as their spacing corresponds to the number of heads of the automatic embroidery machine. Thus a plate 15 can be loaded while the machine is running, and then substituted for a finished group by fitting the plate 15 in appropriate guides. Loading time is therefore reduced drastically.

With the sytem of this invention, whether using the system of FIGS. 1–4, 5, or 6, the backing sheet 4 is first laid on top of the outer ring 1. An intermediate ring 2 or 2′ is then pushed down into it, thereby pressing the sheet 4 down into the ring 1. This sheet 4 is held elastically between the rings 1 and 2 or 2′, and can bunch up at the notches 9 without damage. Since the sides of the rings 1 and 2 or 2′ are only gently arced it is possible to pull the backing sheet 4 snug easily, making it perfectly flat and planar.

The textile piece 5 to be embroidered is then laid on top of the ring 2 or 2′ and the ring 3, 3′, or 3″ is pressed down into it. This action clips the sheet 5 elastically between these rings. In the case of the ring 3″ the sheet 5 can bunch up in the notches 14 without damage. The piece 5 can then be adjusted just like the sheet 4.

Thereafter the finished assembly can be dropped into one of the seats 16 and the cycle can be repeated. Of course when the piece 5 is quite thick and stable it is possible to do without the backing sheet 4.

With this system the two pieces 4 and 5 can be adjusted independently of each other and are both held elastically in such a manner that they will not be pinched and cut. THe system can be used easily and the hoop can be produced at low cost.

I claim:

1. A hoop for holding a piece of textile and a backing web for embroidery on the textile piece, the hoop comprising:

a generally rigid outer ring formed of a limitedly elastically deformable synthetic resin and having a generally polygonal inner periphery generally centered on an axis and being formed of slightly inwardly concave sides each having a central inwardly directed ridge;

an L-section intermediate ring formed of a limitedly elastically deformable synthetic resin and having an outer periphery generally complementary to and axially fittable with limited play within the inner periphery of the outer ring and a generally polygonal inner periphery, whereby the intermediate ring can be elastically deformed and snapped into the outer ring with the backing web gripped between the inner periphery of the outer ring and the outer periphery of the intermediate ring; and an L-section inner ring formed of a limitedly elastically deformable synthetic resin and having an outer periphery generally complementary to and axially fittable with limited play within the inner periphery of the intermediate ring, whereby the inner ring can be elastically deformed and snapped into the intermediate ring with the textile piece gripped between the outer periphery of the inner ring and the inner periphery of the intermediate ring, the intermediate and inner rings each having one flange forming the respective inner periphery and another substantially planar flange generally perpendicular thereto and extending outwardly perpendicular to the axis away from the respective inner flange, the inner flanges each forming a shallow outwardly open groove and the inner flange of the intermediate ring being formed with an inwardly projecting annular ridge, the ridges of the outer and intermediate rings fitting into the respective grooves of the intermediate and inner rings.

2. The embroidery hoop defined in claim 1 wherein the outer ring is of solid and generally rectangular cross section and has a width dimension perpendicular to the axis which is substantially greater than its height dimension parallel to the axis.

3. The embroidery hoop defined in claim 1 wherein both of the inner flanges are generally of radially outwardly open V-section.

4. The embroidery hoop defined in claim 1 wherein the inner flanges are formed with inwardly directed lips of substantially smaller dimension than the respective outer flanges and each perpendicular to the axis.

5. The embroidery hoop defined in claim 1 wherein the inner flange of the inner ring is axially slightly longer than the inner flange of the intermediate ring.

6. The embroidery hoop defined in claim 1 wherein the outer periphery of the intermediate ring is outwardly concave and the inner periphery of the outer ring is generally complementarily inwardly concave but of smaller curvature.

7. The embroidery hoop defined in claim 1 wherein the outer ring has an outer periphery of predetermined shape, the hoop further comprising:

a mounting plate formed with a plurality of holding seats each having a shape complementary to the predetermined shape of the outer periphery of the outer ring, whereby one such outer ring fitted with a respective backing web, intermediate ring, textile piece, and inner ring can be held in each such recess.

8. The embroidery hoop defined in claim 1 wherein the rings are all annularly continuous.

9. The embroidery hoop defined in claim 8 wherein the inner and intermediate rings are of generally uniform section.

10. The embroidery hoop defined in claim 1 wherein the inner and intermediate rings are formed of a polycarbonate.

11. A hoop for holding a piece of textile and a backing web for embroidery on the textile piece, the hoop comprising:

a generally rigid outer ring formed of a limitedly elastically deformable synthetic resin and having a generally polygonal inner periphery generally centered on an axis;

an intermediate ring formed of a limitedly elastically deformable synthetic resin and having an outer periphery generally complementary to and axially fittable with limited play within the inner periphery of the outer ring and a generally polygonal inner periphery, whereby the intermediate ring can be elastically deformed and snapped into the outer ring with the backing web gripped between the inner periphery of the outer ring and the outer periphery of the intermediate ring; and an inner ring formed of a limitedly elastically deformable synthetic resin and having an outer periphery generally complementary to and axially fittable with limited play within the inner periphery of the intermediate ring, whereby the inner ring can be elastically deformed and snapped into the intermediate ring with the textile piece gripped between the outer periphery of the inner ring and the inner periphery of the intermediate ring, the inner periphery of the outer ring having sides meeting at corners and being formed at these corners with inwardly open cutout notches defining respective gaps with the intermediate ring, whereby the web gripped between the outer and intermediate rings can bunch in these notches at the corners.

12. A hoop for holding a piece of textile and a backing web for embroidery on the textile piece, the hoop comprising:

a generally rigid outer ring formed of a limitedly elastically deformable synthetic resin and having a generally polygonal inner periphery generally centered on an axis;

an intermediate ring formed of a limitedly elastically deformable synthetic resin and having an outer periphery generally complementary to and axially fittable with limited play within the inner periphery of the outer ring and a generally polygonal inner periphery, whereby the intermediate ring can be elastically deformed and snapped into the outer ring with the backing web gripped between the inner periphery of the outer ring and the outer periphery of the intermediate ring; and an inner ring formed of a limitedly elastically deformable synthetic resin and having an outer periphery generally complementary to and axially fittable with limited play within the inner periphery of the intermediate ring, whereby the inner ring can be elastically deformed and snapped into the intermediate ring with the textile piece gripped between the outer periphery of the inner ring and the inner periphery of the intermediate ring, the outer periphery of the inner ring having sides meeting at corners and being formed at these corners with outwardly open cutout notches defining respective gaps with the intermediate ring, whereby the textile piece gripped between the inner and intermediate rings can bunch in these notches at the corners.

* * * * *